US006056647A

United States Patent [19]

Tingelstad

[11] Patent Number: 6,056,647

[45] Date of Patent: May 2, 2000

[54] ADJUSTABLE HEAD PUTTER

[76] Inventor: Timothy Loyal Tingelstad, 2840 Country La., Bemidji, Minn. 56601

[21] Appl. No.: 09/205,996

[22] Filed: Dec. 4, 1998

[51] Int. Cl.[7] ..... A63B 53/02; A63B 53/06

[52] U.S. Cl. ..... 473/307; 473/313; 473/340

[58] Field of Search ..... 473/282, 307, 473/313, 314, 324, 340

[56] References Cited

U.S. PATENT DOCUMENTS

| | | | |
|---|---|---|---|
| D. 212,890 | 12/1968 | Rose | 473/314 X |
| 3,679,207 | 7/1972 | Florian . | |
| 3,851,877 | 12/1974 | Giambazi | 473/313 |
| 4,621,816 | 11/1986 | Leek . | |
| 4,832,340 | 5/1989 | Pickering | 473/313 |
| 4,871,174 | 10/1989 | Kobayashi . | |
| 5,348,295 | 9/1994 | Phillips . | |
| 5,388,827 | 2/1995 | Reynolds, Jr. . | |
| 5,429,356 | 7/1995 | Dingle et al. . | |
| 5,454,564 | 10/1995 | Kronogard . | |
| 5,456,464 | 10/1995 | Davenport et al. . | |
| 5,533,725 | 7/1996 | Reynolds | 473/307 |
| 5,533,730 | 7/1996 | Ruvang | 473/251 |

FOREIGN PATENT DOCUMENTS 646942 8/1962 Canada .

*Primary Examiner*—John A. Ricci
*Attorney, Agent, or Firm*—Curtis V. Harr

[57] ABSTRACT

An improved golf putter with an adjustable putter head. The putter head has five possible points of attachment to the shaft. All five of the attachment points are on the same plane. Each of the attachment points for the shaft allow an adjustment to the lie and ball position by swiveling the shaft forward and backward from the putter head. The putter head is also adjustable as to weight and balance for each shaft position chosen. The putter is designed primarily to allow the golfer to utilize a straight forward putting stroke, but also allows the golfer to use the standard putting stroke or any variation in between. The putter has two opposing faces with two different lofts to allow the golfer to adjust the putter for different putting surfaces. Each of the putter faces can be used by either a right handed or left handed golfer. The putter's adjustability allows each individual golfer to adapt the putter to each golfer's individual size shape and putting style.

19 Claims, 7 Drawing Sheets

FIG 3
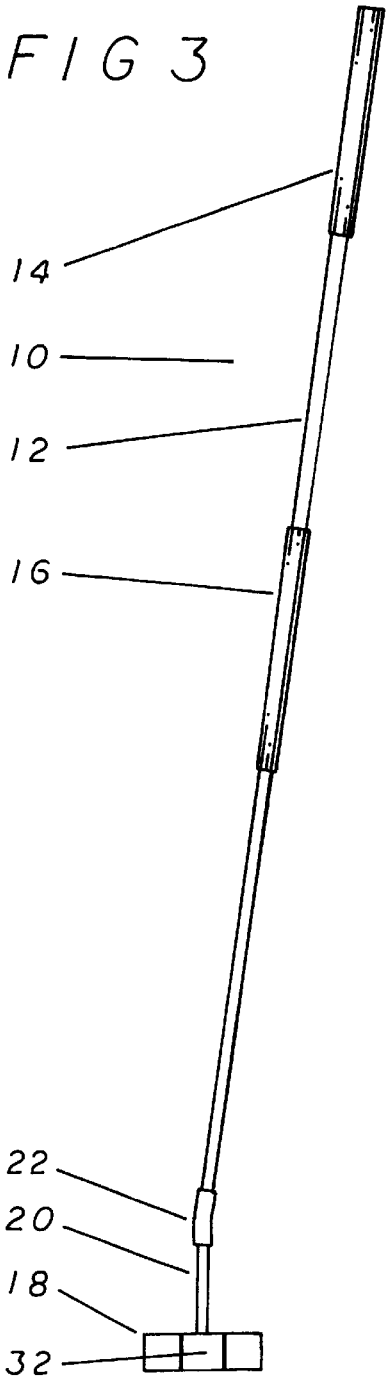
FIG 4
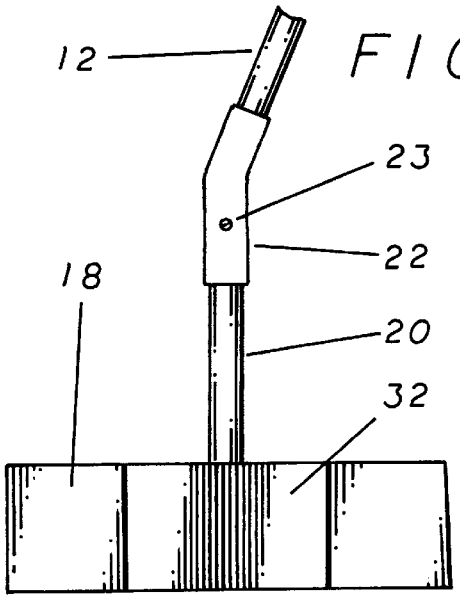
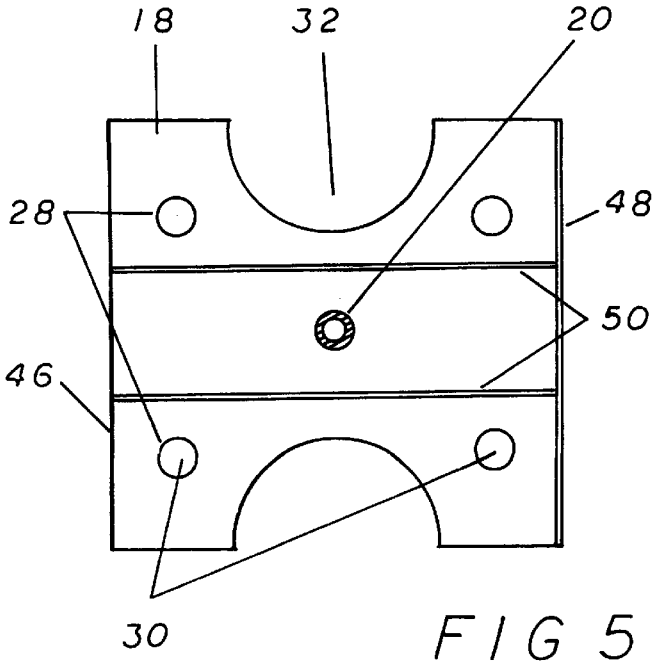
FIG 5

FIG 6
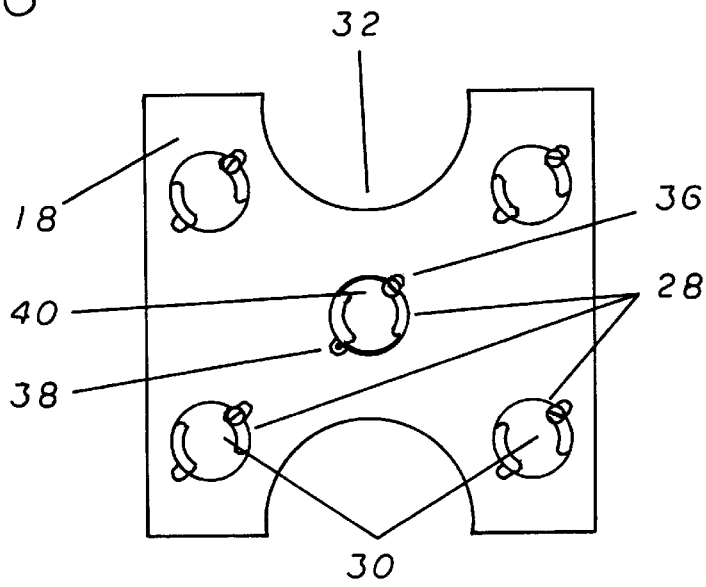
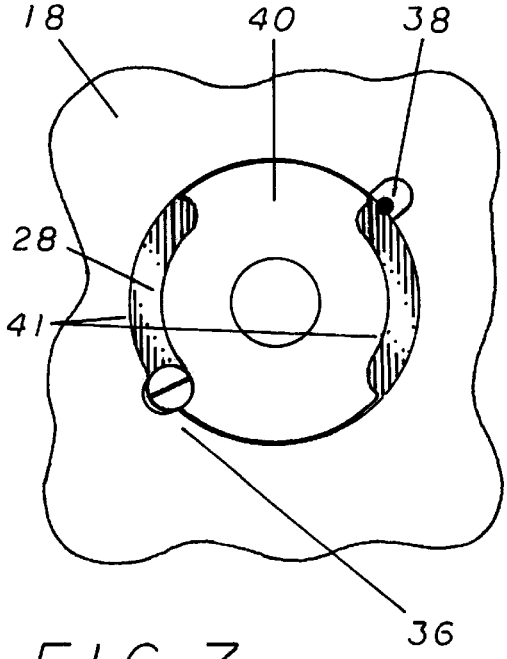
FIG 7
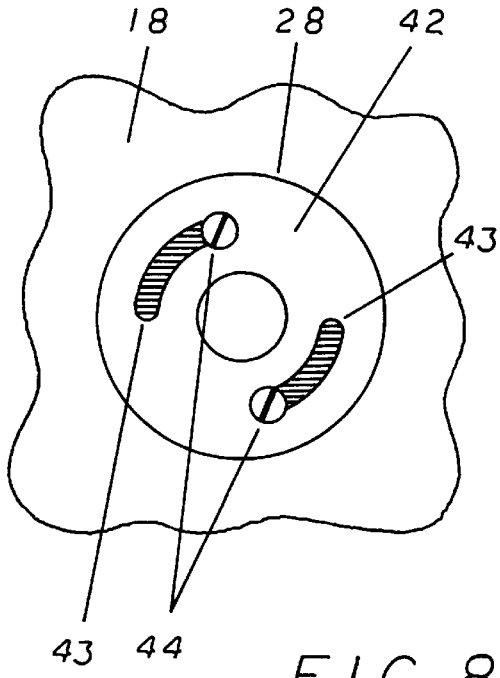
FIG 8

FIG 9
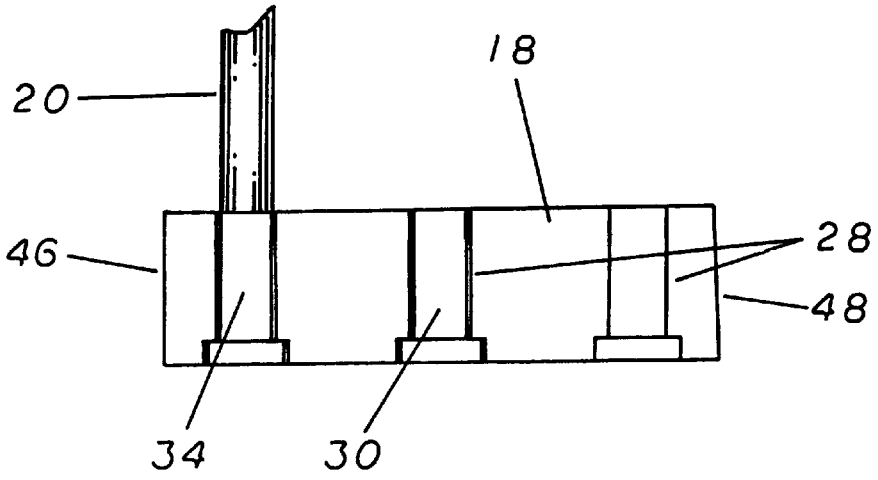
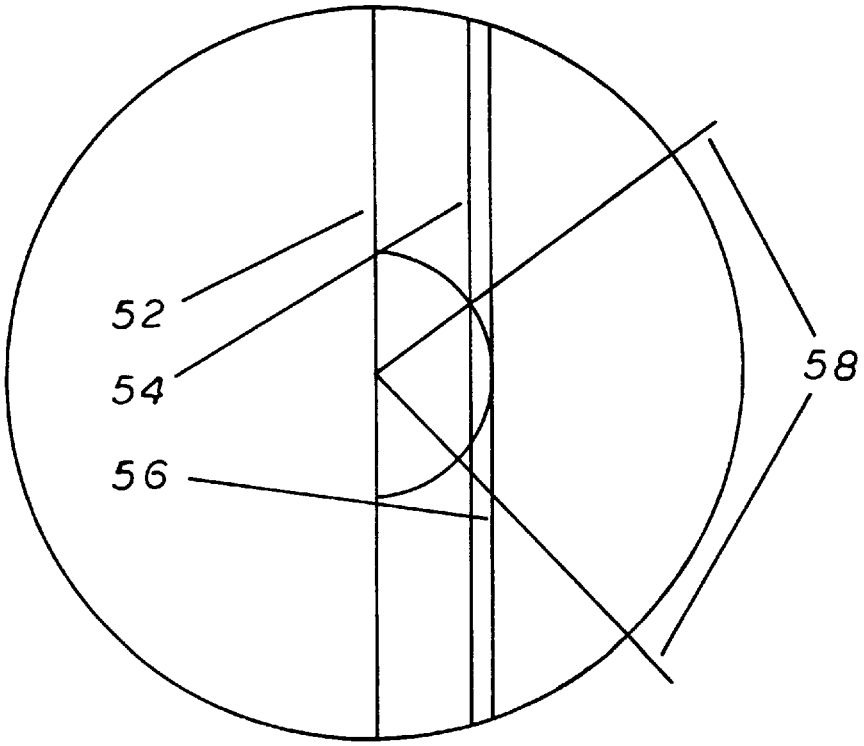
FIG 10

FIG 12
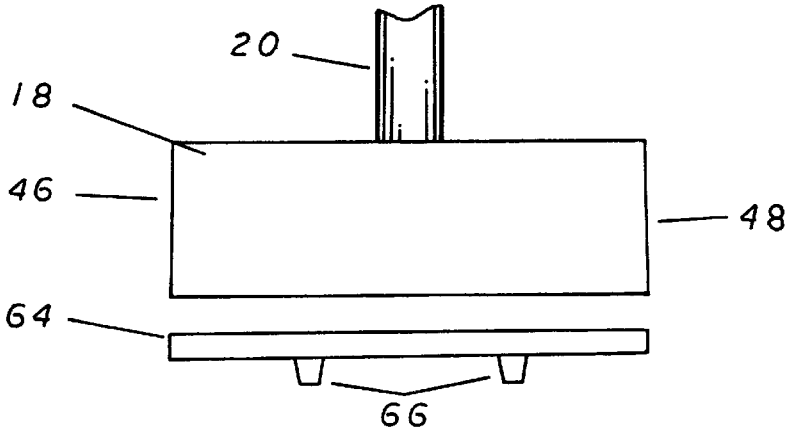
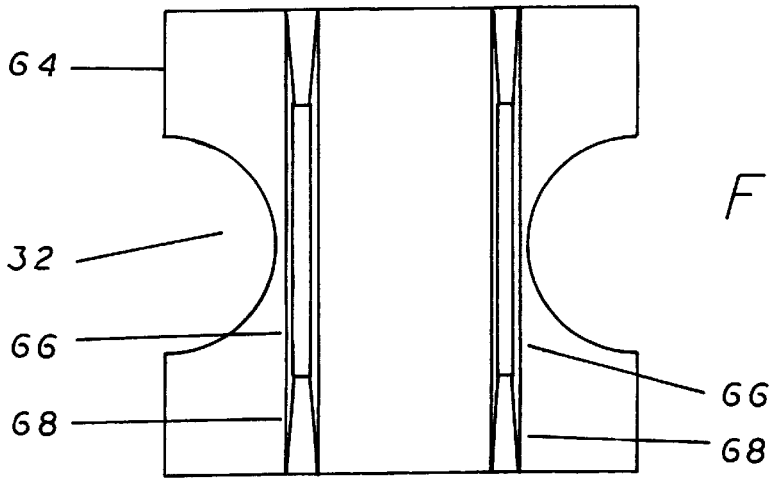
FIG 13
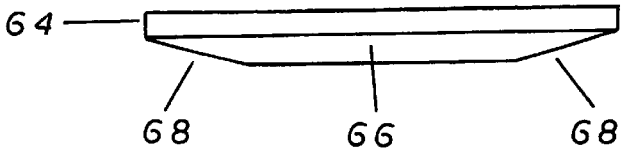
FIG 14

ADJUSTABLE HEAD PUTTER

BACKGROUND OF THE INVENTION

The present invention relates to an improvement in the design of a putter used in the game of golf which will enable the golfer to take full advantage of the many benefits of using alternative putting methods including a straight forward putting stroke. There are currently no known putters, which make alternative putting methods, including the straight forward putting stroke attractive to a large number of golfers with various putting styles and of varying stature.

While the game of golf has seen numerous evolutions in both the areas of club design and methods of executing the stroke, there have been very few instances where an evolution of both equipment and method have occurred at the same time. The present invention is in effect is one of those rare occasions. While the present invention addresses only the equipment aspect of this new putting concept, the method of using this invention is of equal importance.

Over the history of the game of golf, experts and professionals have often differed in their opinions as to what constitutes the best style of putting stroke. There does currently appear to be general consensus among professionals today that the best putting stroke is a pendulum type stroke which uses the golfer's large shoulder muscles rather than the golfer's wrists and hands. It is the intent and design of this invention to develop a putter which allows the golfer to emulate a true pendulum putting stroke to the greatest extent possible under the current United States Golf Association (USGA) rules of golf.

Several prior art putters show adjustable configurations for putters for example the Phillips U.S. Pat. No. 5,348,295 and the Ruvang U.S. Pat. No. 5,533,730 both show golf putters which are adjustable in configuration and weight. However, neither of these putters allow a user to adjust for a whole new putting style but are rather used to fine tune an existing style of putting.

From the forgoing discussion it can be seen that it would be advantageous to provide a putter that would enable a golfer to strike a golf ball on the putting green with a putting stroke that imitates a pure pendulum motion as much as possible under the rules of the USGA. Additionally, it can be seen that it would be advantageous to provide a putter that can utilize this type of stroke while allowing the golfer vary his or her stance as desired for a particular play style.

SUMMARY OF THE INVENTION

It is the primary objective of the present invention to provide a golf putter that is designed with an adjustable head which will allow a golfer to take full advantage of the many benefits associated with using a putting stroke in which he is facing directly at the hole and his target line or in the conventional manner of addressing the ball.

It is an additional objective of the present invention to provide a putter that allows a golfer to emulate a true pendulum putting stroke to the greatest extent possible under the current USGA rules of golf.

It is still a further objective of the present invention to provide such a putter that will enable a golfer to employ the most simple, natural and repeatable putting stroke possible.

It is the final objective of the present invention to provide such a putter that is user friendly in that it is very attractive to the golfer's sight and is easily lined up to the target.

These objectives are accomplished by the use of a putter that is designed to be adjustable to each golfer's personal preferences as to posture and ball position. The design of this putter and its combination with either a straight forward putting stroke or a conventional address is intended to be as similar to simply rolling the ball to the cup with the golfer's dominant arm as possible. Because each golfer has a different build, stature and style, what feels most natural to one golfer may not feel the most natural to another golfer.

The design of the present invention provides a method of achieving this type of putting stroke while conforming with the USGA rules of golf. The rule of most significant is Rule 4-1*b* of Appendix II. This rule in effect prohibits a putter design which allows a pure pendulum stroke, by making it illegal to have a shaft which is completely vertical over the putter head. The rule allows for the shaft to be vertical for only the first five inches from the sole of the putter head. From the point five inches above the sole of the putter head, the shaft must diverge from the vertical by at least 10 degrees on the vertical toe heel plane. The shaft can also diverge along the intended line of play no more than 20 degrees. The present invention is the first putter to combine these two divergence rules in a manner to allow a certain amount of adjustability in the lie of the putter. This adjustability will hereinafter be referred to as "swivel adjustment".

The use of a 10 degree bend in the shaft at the point five inches above the sole of the putter head would not allow for any swivel adjustability. Swivel adjustability is very important in the design of this invention to allow each golfer to adjust the putter to the golfer's own preference. This invention therefore, in its preferred embodiment, utilizes a shaft bend angle of between 12 and 13 degrees at the point five inches above the sole of the putter head. A shaft bend angle of 12 degrees will allow the shaft to be swivelled either forward or backward at an angle of approximately 34 degrees in each direction, while still maintaining no less than the 10 degree divergence angle from the vertical plane through the toe and heel of the putter head. An angle of more than 13 degrees results in the putter head being uncomfortably far from the golfer's body.

It has been found that a mathematical formula of $Y=\cos^{-1}(\tan 10°/\tan X)$, where Y is the degrees of swivel forward and backward of the shaft and X is the angle of shaft bend, can be used to approximate the degrees of swivel for a particular configuration. Through the use of this formula it can be proven that a particular configuration can be used to a allow a certain amount of adjustability while still complying with USGA rules.

The second part of the USGA Rule 4-1*b* of Appendix II which is utilized by this invention in a manner different from any other putter is the portion of this rule dealing with the shaft's attachment to the club head. This rule allows the shaft of the putter to be attached at any point on the putter head. While other putters have had more than one possible point of attachment, this is the first putter to have five adjustable attachment points all on the same plane across the top of the putter head. Each of these five attachment points will allow the same swivel adjustability. The five attachment points on the putter head are carefully identified to accomplish maximum adjustment in ball position, while maintaining a balanced putter head. The placement of these five attachment points also enables the golfer to utilize both putter faces as desired. The golfer's use of the four outside attachment points allows the golfer to accomplish the goal of placing the golfer's hand as close to the vertical point above the putter head as is allowed under the rules of golf. The result is also to bring the ball placement as close to the body as possible. The golfer's choice of a forward or backward attachment point gives the golfer the ability to move the desirable ball placement forward and backward accordingly. This adjustability also allows the putter to be utilized by both right handed and left handed golfers.

Because the aesthetic appearance of a putter is of great importance, all adjustability of this invention has been designed to be accomplished on the sole of the putter head rather than on the top of the putter head. To accomplish adjustability on the sole of the putter head, it is necessary to have three major pieces to each putter: 1) the putter head, 2) the shaft and 3) the neck extension. The neck extension is composed of a 5 inch rod of equal diameter to the shaft (approximately 1 cm). The rod is attached to a 2 cm disc at one end. The disc has two semicircular shaped notches which allow the swivel adjustability. When the golfer has placed the shaft in its desired position, two small screws are inserted through the notches in the disc and into the club head. This tightens the neck extension into place and secures the neck extension onto the putter head.

The top end of the neck extension is then inserted into an elbow joint with an angle of approximately 12 to 13 degrees. The elbow joint has been permanently fastened to a straight shaft of the golfer's desired length. The elbow joint has a small holed drilled through it. This hole is then aligned with a hole drilled at the top of the neck extension. Set screws are then inserted through the holes in the elbow joint and neck extension to secure the shaft in a pre-established position. This process is necessary to prevent the golfer from placing the putter in a position which is in violation of the rules of golf.

The four attachment holes which are not used by the golfer are used to make the putter adjustable to weight and balance. The putter will come with four weights to be used in the four attachment points that are not used for the neck extension. The four weights are made in the same fashion as the neck extension, with the exception that they do not extend beyond the top of the putter head surface. The weights can be made of any material necessary to accomplish balance to the putter head.

Finally, it is the intent and design of this invention to create a putter which is user friendly. The putter is designed to be very attractive to the golfer's sight, and to be very easy for the golfer to line up with the target. The putter is also designed to be well balanced and weighted regardless of how the individual golfer chooses to adjust the shaft position. The putter is designed to allow the golfer to pick up the ball without bending over. The putter is designed to be used with either a long or standard length shaft.

For a better understanding of the present invention reference should be made to the drawings and the description in which there are illustrated and described preferred embodiments of the present invention.

DESCRIPTION OF THE DRAWINGS

FIG. 3 is a side elevation view of the present invention illustrating the orientation of its major components.

FIG. 4 is a side elevation view of the present invention detailing the method of construction of the variable putter shaft and putter head.

FIG. 5 is a top elevation view of the present invention detailing the orientation of the multiple shaft attachment holes within the surface of the putter head.

FIG. 6 is a bottom elevation view of the present invention showing the orientation of the shaft attachment plates on the bottom of the putter head.

FIG. 7 is a close up cut-away view of the shaft attachment plate of the present invention detailing one manner by which the attachment is made and also the method by which the attachment is adjustable.

FIG. 8 is a close up cut-away view of the shaft attachment plate of the present invention detailing another manner by which the attachment is made and also the method by which the attachment is adjustable.

FIG. 9 is a side elevation cut-away view of the putter head component of the present invention detailing the manner in which the multiple attachment holes are used to attach the putter shaft to the head and also how the unused holes are plugged.

FIG. 10 is a schematic representation of the possible rotation axis of the shaft of the present invention.

FIG. 12 is front elevation view of an alternative embodiment of the present invention in which the sole plate of the putter head is equipped with a pair of runners that aid the putter in gliding over the putting surface.

FIG. 13 is a bottom elevation view of the sole plate of the alternative embodiment of the present invention showing the orientation of the runners in relation to the sole plate.

FIG. 14 is a side elevation view of the sole plate of the alternative embodiment of the present invention showing the orientation of the runners in relation to the sole plate.

Figure 1:
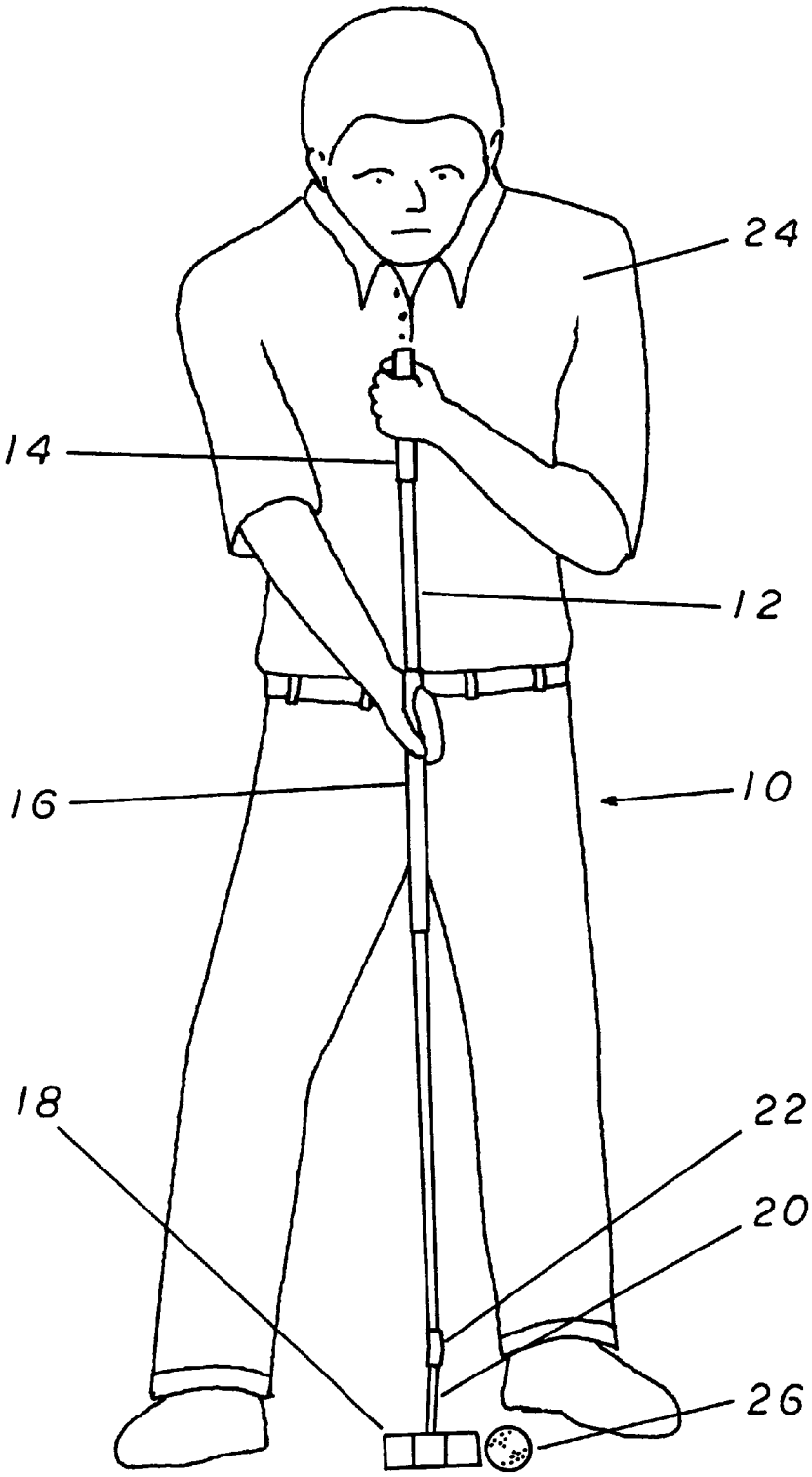
FIG. 1 is a perspective view of the present invention showing its major components and as being employed by a golfer in the conventional method of addressing a golf ball prior to initiating the putting stroke.
Figure 2:
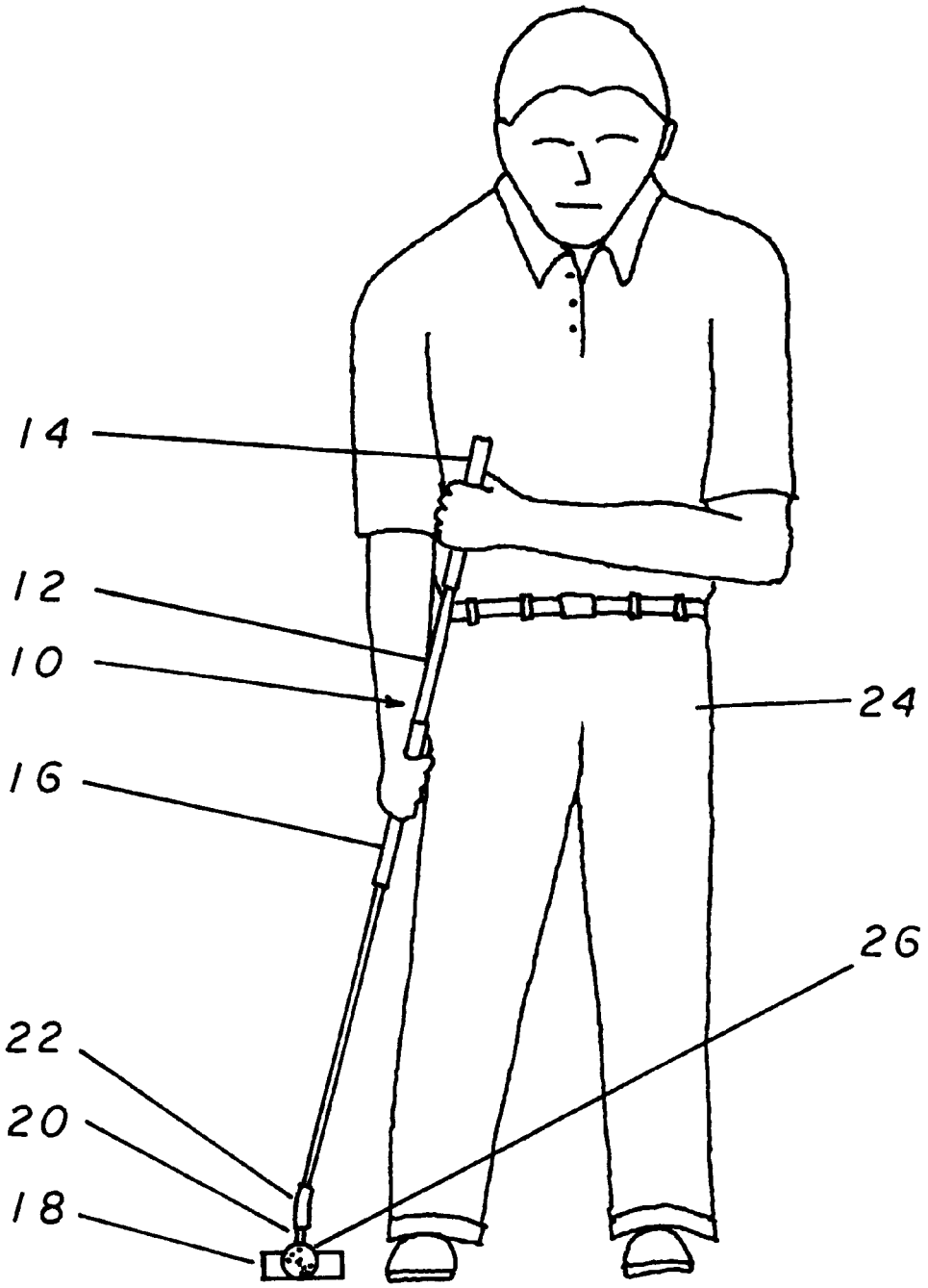
FIG. 2 is a perspective view of the present invention showing its major components and as being employed by a golfer in the forward facing method of addressing a golf ball prior to initiating the putting stroke.

DESCRIPTION OF THE PREFERRED EMBODIMENT:

Referring now to the drawings, and more specifically to FIGS. 1, 2 and 3, the adjustable head putter 10 is made up of an adjustable head 18 which is attached to the putter shaft 12 by means of the shaft coupler 22 and the vertical neck extension 20. The vertical neck extension 20 is the portion of the present invention which is directly attached to and extends vertically in an upward fashion (up to five inches) from the putter head 18 as allowed for in USGA Rule lb of Appendix II. The required divergence of the putter shaft 12 from the vertical is accomplished by the shaft coupler 22 which attaches at its lower end to the vertical neck extension 20 and at its upper end to the putter shaft 12.

The present invention is employed by a golfer 24 by grasping the lower club grip 16 with his dominate hand and the upper club grip 14 with his subordinate hand and addressing the golf ball 26 (the method of addressing the ball 26 in the conventional, or sideways, position is Illustrated in FIG. 1 and the forward facing method of addressing the ball 26 is illustrated in FIG. 2). The adjustability of the present invention thus allows a golfer 24 to use the type of putting stroke which suits his individual characteristics. It is also important to note that the present invention, or more specifically the adjustable head 18, is capable of being effectively used with a putter shaft 12 of the more common short variety. Additionally, the adjustable head 18 is equipped with two spherical ball holder 32 indentations on either of its non-putting outside surfaces. These features enable a golfer 24 to pick up a golf ball 26 off the surface of the ground without bending over to pick it up.

The manner of construction of the adjustable putter head 18 is further illustrated in FIGS. 4, 5, 6, 9 and 11. The adjustable putter head 18 is composed of a cast or milled metallic cube having two separate putting surfaces on two corresponding opposite sides of the cube. One of the putting surfaces has a one degree upwardly oriented putting face 46 while the other has a four degree upwardly orientated putting face 48. It should be further stated at this point that the degrees of loft of the putting faces 46 and 48 may be varied during manufacturing or as necessary to conform with USGA rules, also the putting faces 46 and 48 may contain insets, curvature, or other features (not shown) as desired by various golfers 24. These two putting faces allow a user to control the amount of lift applied to the golf ball 26 on impact and, therefore, imparts the ability to the golfer 24 to maximize the effectiveness of the present invention when used in conjunction with his particular stroke. Additionally, the upper surface of the adjustable putter head 18 is equipped with a pair of stroke alignment lines 50 which aid the golfer in lining up the putter head 18 with the intended target line and further identify the "sweet spot" or intended point of impact with the golf ball 26.

The other two opposite surfaces of the adjustable putter head 18 contain the two ball holder 32 indentations. The ball holders 32 are formed into the adjustable putter head 18 and are hemispherical in shaped into a diameter just large enough to enable them to lightly grasp and hold a golf ball 26. This holding ability of the ball holder 32 may be enhanced by a slight tapering of its walls from the top to the bottom which keeps the ball 26 from falling completely through the ball holder 32. Again, this allows a golfer 24 to pick up balls 26 off the ground without the need to bend over, thus, saving on stress to the lower back and knees.

These figures also illustrate the method used to attach the adjustable putter head 18 to the vertical neck extension 20 which is in turn attached to the putter shaft 12. The vertical neck extension 20 is attached to the putter shaft 12 by the use of the shaft coupler 22. The shaft coupler 22 is a hollow tube having the upper portion of the tube bent to the desired angle (something greater than ten degrees) in relation to the vertical neck extension 20. The attachment is accomplished by having the shaft coupler 22 permanently attached to the putter shaft 12 at the shafts lower most end. The attachment of the shaft coupler 22 to the vertical neck extension 20 is accomplished by the use of the coupler set screw 23 which is threaded into the vertical neck extension 20.

The adjustable putter head 18 is also equipped with a plurality of separate shaft attachment holes 28. These attachment holes 28 allow the vertical neck extension 20, and therefore the putter shaft 12, to be mounted to the putter head 18 in a variety of different locations further allowing the golfer 24 to adjust the characteristics of the present invention to his individual needs. For example, many golfers 24 will prefer the putter shaft 12 be mounted in the center of the putter head 18 in which case they would use the center attachment hole 28 to make the attachment. Others will prefer that the putter shaft 12 be mounted on the leading or trailing edge of one of the two putting surfaces of the putter head 18 in which case one of the other provided attachment holes 28 would be used. The choice of the attachment hole 28 to be used will be determined by the style of putting stroke being employed. This design feature of the present invention further enhances its versatility providing additional means by which the orientation of the putter head 18 adjusted to fit the needs of individual golfers 24.

The method of attachment of the vertical putter shaft 20 to the adjustable putter head 18 is detailed in FIGS. 6,7,8,9 and 11. To make the attachment, the shaft coupler 22 is removed from the vertical neck extension 20 which is then passed from below the putter head 18 through the desired attachment hole 28. The lowest most portion of the vertical neck extension 20 is the attachment plug 34 and it is this component which fits within and is secured to the attachment hole 28. The securement of the shaft attachment plug 34 to the putter head 18 is accomplished by the use of the notched or slotted attachment plates, 40 and 42, which are attached to the bottom end of the shaft attachment plug 34. The attachment plates, 40 and 42, are in turn attached to the putter head 18 by the use of the shaft attachment plate screws, 36 and 44. This configuration holds the putter shaft 18 securely to the adjustable putter head 18. The shaft attachment holes 28 not being employed in the desired configuration of the present invention are plugged by the use of the attachment hole plugs 30 which are fixed to the adjustable putter head 18 in the same fashion as the shaft attachment plug 34 as described previously.

The attachment of the notched and slotted shaft attachment plates, 40 and 42, are detailed in FIGS. 7 and 8. There are two designs of the attachment plates, the first of which is a circular plate having two notches 41 cut along opposite sides of the notched attachment plate 40 and each covering approximately 68 degrees of the plate's circumference; this configuration is illustrated in FIG. 7. The notches 41 provide a point of adjustable attachment as the notched plate attachment screw 36 screws into the screw hole 38 within the opening left by the notch 41. The length of the notches 41 allows the notched attachment plate 40 to be rotated to the desired position before the attachment screws 36 are tightened down to hold the attachment plate 40 in the selected position. This prevents the adjustable head putter 10 from being placed in a configuration not in conformance with USGA rules.

The slotted shaft attachment plate 42 is similar in construction as the notched plate 40 but has the adjustment openings contained within the body of the slotted attachment plate 42. The slotted attachment screws fit within the slots 43 where they are tightened in the same manner as discussed above. This point of the putter shaft 12 adjustment provides a means by which the user can personalize the characteristics of the present invention.

Figure 11:
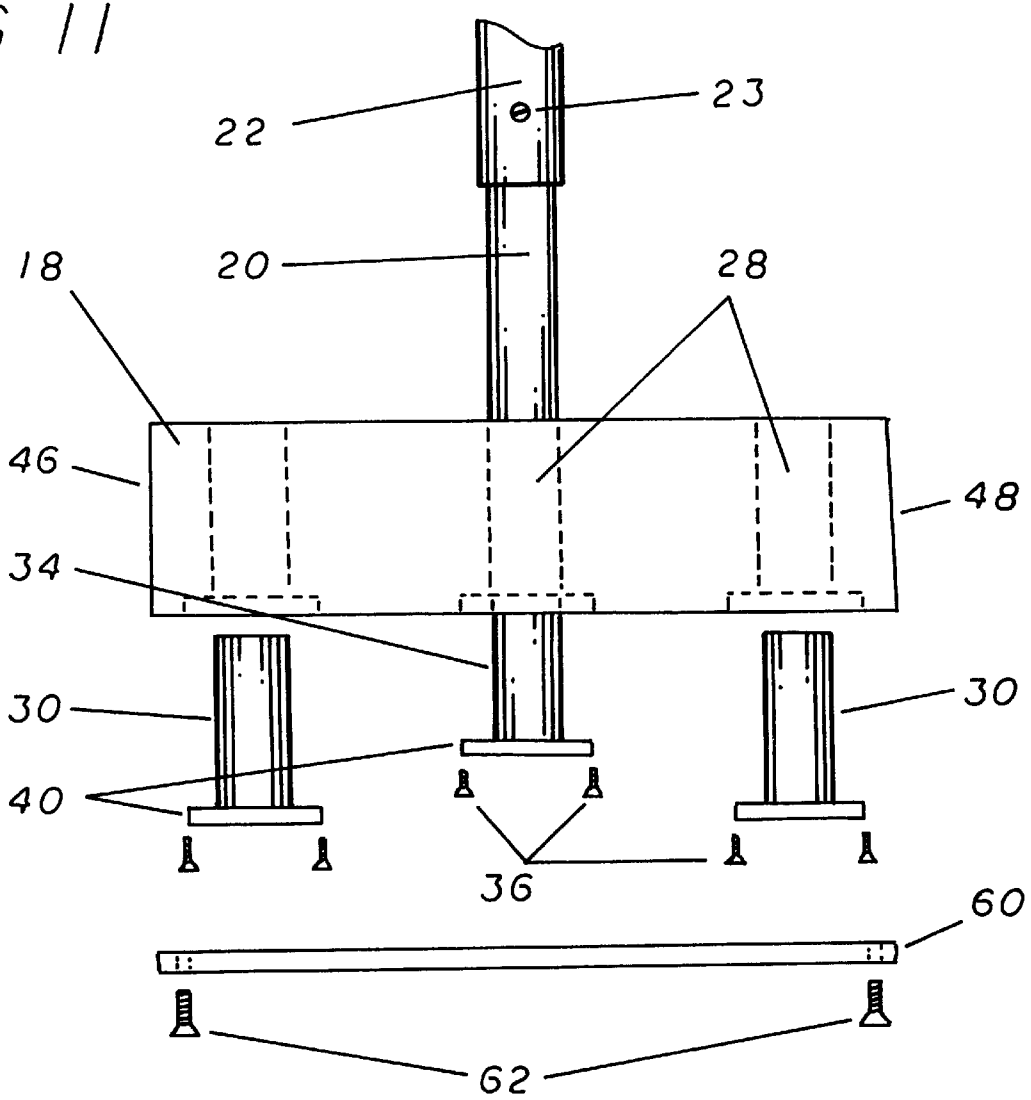
FIG. 11 is a side elevation exploded view of the putter head of the present invention showing the manner in which the shaft attachment holes are employed to attach the shaft to the putter head and the use of a sole plate.

FIG. 11 illustrates the use of a sole plate 60 which is employed to cover the bottom surface of the adjustable putter head 18. The sole plate 60 is a relatively thin piece of metal which is formed to match the shape of the putter head 18. It is attached by the use of sole plate attachment screws 62 which pass through the sole plate 60 and are threaded into the body of the putter head 18. The sole plate 60 covers the shaft attachment plates 40 and 42, to ensure that no dirt or other foreign debris damages the putter shaft 12 attachment components of the present invention.

An alternative embodiment of the present invention in which a runner sole plate 64 is provided is illustrated in FIGS. 12, 13 and 14. These runners 66 extend downward from the surface of the runner sole plate 64 and serve the purpose of lifting the putter head 18 slightly off the putting surface to allow it to move more freely during the putting stroke. The runners 66 extend longitudinally from the front to the rear of the runner sole plate 64 and are designed with beveled surfaces 68 which taper towards their outer edges on both ends in relation to the sole plate 64. This design allows the putter head 18 to be stroked back and through the golf ball 26 in a pendulum motion without snagging or catching the leading edge of the runners 66 or the putter head 18 on the putting surface. The runners 66 also assist the golfer 24 in keeping the putter head 18 square with the target during the putting stroke. Additionally, the runners 66 are constructed to a height sufficient to accomplish this but not so high that they interfere with the contact of the putter head 18 to the golf ball 26.

FIG. 10 is a schematic representation of the adjustment parameters of the present invention as they relate to USGA rules. In the diagram the vertical line running through the circle represents the vertical axis 52 of the putter shaft 12. The 10 degree divergence 54 is shown by the vertical line directly to the right of the vertical axis 52 this represents a divergence of approximately ten degrees from the vertical, the minimum amount of divergence allowed by the USGA's rules of golf. The 12 to 13 degree divergence 56 is shown by a second the vertical line and represents a further divergence as typically employed with the present invention. The two diagonal lines extending to the right of the circle illustrate the available degrees of shaft rotation 58 that can be employed to adjust the present invention to fit the needs of individual golfers 24, with a 12 to 13 degree divergences as shown this may be approximately 34 degrees in each direction. This adjustability allows a golfer 24 to vary the adjustable head putter 10 while preventing the use of a configuration which does not conform with USGA rules. FIG. 10 is also a schematic of the mathematical formula $Y=\cos^{-1}(\tan 10°/\tan X)$, where Y is the degrees of swivel forward and backward of the shaft in a USGA legal configuration as shown by 58 and X is the angle of shaft bend as shown by 56.

Although the present invention has been described in considerable detail with reference to certain preferred versions thereof, other versions are possible. Therefore, the spirit and scope of the appended claims should not be limited to the description of the preferred versions contained herein.

What is claimed is:

1. An adjustable head putter for use in various putting styles said putter comprising:

a substantially rectangular putter head having a top surface, a bottom surface, a front putter face surface for contact with a ball, a rear putter face and a top and bottom face;

said putter head further defining at least one shaft attachment hole passing vertically through said putter head from said top surface to said bottom surface at an angle substantially perpendicular to said bottom surface;

a neck extension having a first and second end with a plate mounted to said second end;

a means of pivotally attaching said plate to said putter head so as to allow said neck extension to pass through said shaft attachment hole and extend above said putter head's top surface; and an elongate putter shaft attached to said neck extension at angle of at least 10 degrees divergence from said neck extension.

2. An adjustable head putter as in claim 1 wherein said rear putter face is a surface that may be used for contact with a ball.

3. An adjustable head putter as in claim 2 wherein said means of pivotally attaching said plate to said putter head is limited pivotally in each direction.

4. An adjustable head putter as in claim 3 further comprising a sole plate removably attached to the bottom surface of said rectangular putter head.

5. An adjustable head putter as in claim 4 wherein said elongate putter shaft further comprises an upper and lower putter grip.

6. An adjustable head putter as in claim 5 further comprising a right and left semi circular ball holder section defined by said rectangular putter head's top and bottom face.

7. An adjustable head putter as in claim 6 wherein said putter head defines five shaft attachment holes.

8. An adjustable head putter for use in various putting styles said putter comprising:

a substantially rectangular putter head having a top surface, a bottom surface, a front putter face surface for contact with a ball, a rear putter face and a top and bottom face;

said putter head further defining at least five shaft attachment holes passing vertically through said putter head from said top surface to said bottom surface at an angle perpendicular to said bottom surface;

a neck extension having a first and second end with a plate mounted to said second end;

a means of pivotally attaching said plate to said putter head so as to limit the extent to which said plate may pivot and so as to allow said neck extension to pass through one of said shaft attachment holes and to extend above said putter head's top surface;

at least one attachment hole plug in at least one of said attachment holes; and an elongate putter shaft attached to said neck extension at angle of at least 10 degrees divergence from said neck extension.

9. An adjustable head putter as in claim 8 wherein said rear putter face is a surface that may be used for contact with a ball.

10. An adjustable head putter as in claim 9 wherein said rear putter face is not parallel to said front putter face.

11. An adjustable head putter as in claim 10 further comprising a sole plate removably attached to the bottom surface of said rectangular putter head.

12. An adjustable head putter as in claim 11 wherein said elongate putter shaft further comprises an upper and lower putter grip.

13. An adjustable head putter as in claim 12 further comprising a right and left semi circular ball holder section defined by said rectangular putter head's top and bottom face.

14. An adjustable head putter for use in various putting styles said putter comprising:

a substantially rectangular putter head having a top surface, a bottom surface, a front putter face surface for contact with a ball, a rear putter face that is not parallel to said front putter face and a top and bottom face;

said putter head further defining at least five shaft attachment holes passing vertically through said putter head from said top surface to said bottom surface at an angle perpendicular to said bottom surface, said attachment holes arranged about all edges of said top surface with one attachment hole in substantially the center of said top surface of said putter head;

a neck extension having a first and second end with a plate mounted to said second end;

a circular plate for pivotally attaching said plate to said putter head so as to limit the extent to which said plate may pivot and so as to allow said neck extension to pass through one of said shaft attachment holes and to extend above said putter head's top surface;

at least one attachment hole plug in at least one of said attachment holes;

a right and left semi circular ball holder section defined by said rectangular putter head's top and bottom face; and an elongate putter shaft fixedly attached to said neck extension at angle of at least 10 degrees divergence from said neck extension.

15. An adjustable head putter as in claim 14 wherein said rear putter face is a surface that may be used for contact with a ball.

16. An adjustable head putter as in claim 15 further comprising a sole plate removably attached to the bottom surface of said rectangular putter head.

17. An adjustable head putter as in claim 16 further comprising runners defined by said sole plate.

18. An adjustable head putter as in claim 17 wherein said elongate putter shaft further comprises an upper and lower putter grip.

19. An adjustable head putter as in claim 18 further comprising stroke alignment markings on said top surface of said rectangular putter head.

* * * * *